United States Patent [19]

Holmes

[11] 4,215,893

[45] Aug. 5, 1980

[54] SYNCHRONIZED EXPANDABLE SPREADER

[75] Inventor: William K. Holmes, Rothschild, Wis.

[73] Assignee: J. I. Case Company, Racine, Wis.

[21] Appl. No.: 947,551

[22] Filed: Oct. 2, 1978

[51] Int. Cl.[2] ..... B66C 1/66

[52] U.S. Cl. ..... 294/81 SF; 294/67 DA

[58] Field of Search ..... 294/81 SF, 67 DA, 67 D, 294/67 R, 67 AA, 88; 414/620, 621, 730

[56] References Cited

U.S. PATENT DOCUMENTS

| | | | |
|---|---|---|---|
| 3,627,370 | 12/1971 | Whiteman et al. | 294/81 SF |
| 3,675,960 | 7/1972 | Mangold | 294/81 SF |

FOREIGN PATENT DOCUMENTS

| | | | |
|---|---|---|---|
| 1281023 | 7/1972 | United Kingdom | 294/81 SF |

*Primary Examiner*—James B. Marbert

*Attorney, Agent, or Firm*—Dressler, Goldsmith, Shore, Sutker & Milnamow, Ltd.

[57] ABSTRACT

A spreader for lifting containerized cargo includes a base section and a pair of extensible sections telescoped on the base section with independent drive means for extending and retracting each of the sections with respect to the base section. A synchronizing mechanism for controlling extension and retraction of the two extensible sections on the base section includes first and second cables respectively interposed between the base section and each of the extensible sections to produce equal increments of movement of both extensible sections with respect to the base.

9 Claims, 3 Drawing Figures

SYNCHRONIZED EXPANDABLE SPREADER

BACKGROUND OF THE INVENTION

The present invention relates generally to spreaders or lifting beams and more particularly to an expandable spreader capable of being utilized for lifting containers of different sizes.

In recent years, considerable emphasis has been directed towards development of units that can be utilized for moving containerized cargo in dock and railroad areas. The most common type of unit that has been utilized for this purpose consists of some type of U-shaped frame which defines an open cargo container bay and the unit is usually self-propelled so that it can be manipulated to place a container in the bay area. This type of unit or straddle carrier conventionally has a spreader located within the bay area which can be raised and lowered and the container has corner fittings or castings having apertures of standard design with the spreader having latching mechanisms at the four corners thereof which are received into the apertures in the castings and secured therein so that the containers can be lifted and transported.

In the past few years, the sizes of containers have become fairly standard. Usually, the containers are 8 feet high and 8 feet wide and the most common lengths have been 20 or 40 feet. However, there are some containers of intermediate lengths, such as 30 or 35 feet and a few containers of various other intermediate lengths.

Since it is extremely critical to maintain the longitudinal spacing between the latching mechanisms on the spreader, it has become fairly common to have the spreader designed for the minimum length containers and to attach sub-frames of fixed lengths with latching mechanisms to the spreader to accommodate the other container lengths. However, this is very costly and requires considerable time to make all of the mechanical, hydraulic and electrical connections when a conversion is necessary.

In order to overcome this problem, numerous expandable spreaders have been proposed. One type of expandable spreader that has been proposed consists of a base section and expandable sections with latching mechanisms supported on the expandable sections.

When using two expansible spreader sections supported on a base section, for various reasons, the two extensible sections should be extended in approximately equal increments at the same time. Heretofore, this has been accomplished with rather complicated mechanisms such as motors with synchronized drive mechanisms for the respective sections or a rack and pinion interconnection between the base section and the expandable sections. Another proposed solution is to use plural cylinder and piston rod assemblies as the extension and retraction mechanism.

While such proposed synchronizing mechanisms may be acceptable for performing the intended function, the mechanisms heretofore proposed are rather complicated and add substantially to the overall cost of the spreader.

SUMMARY OF THE INVENTION

According to the present invention, an extremely simplified synchronizing mechanism for moving the two extensible sections of a spreader or lifting frame in equal increments on a base section is capable of being incorporated into a spreader having conventional components with only minimum modification thereof. The synchronizing mechanism allows for use of conventional drive members, such as fluid cylinder and piston rod assemblies, which are standard commercial components.

More specifically, the synchronizing mechanism for a spreader having a base section and two extensible sections telescoped thereon that are extended and retracted through fluid rams consists of first and second cables that are respectively interposed between the base section and both expandable sections. The two cables are respectively positioned such that at least one of the two cables will perform the synchronizing function at all times. In the specific embodiment illustrated, each cable has an intermediate portion entrained over a pulley that is supported on an end of the base section and opposite ends of the cables are respectively secured to the inner ends of the expansible sections or members. More specifically, a first cable has one end connected to an inner end of a first extensible member and extends generally parallel to the path of travel for that section with the intermediate portion of the cable entrained over a pulley supported on one leg of the base section and the opposite end of the cable is connected to the inner end of the second extensible member.

According to another aspect of the invention, the expansible members are designed and supported on the base section in a fashion that the two expansible sections or members can be identical in configuration.

DETAILED DESCRIPTION

Figures 1, 2, 3:
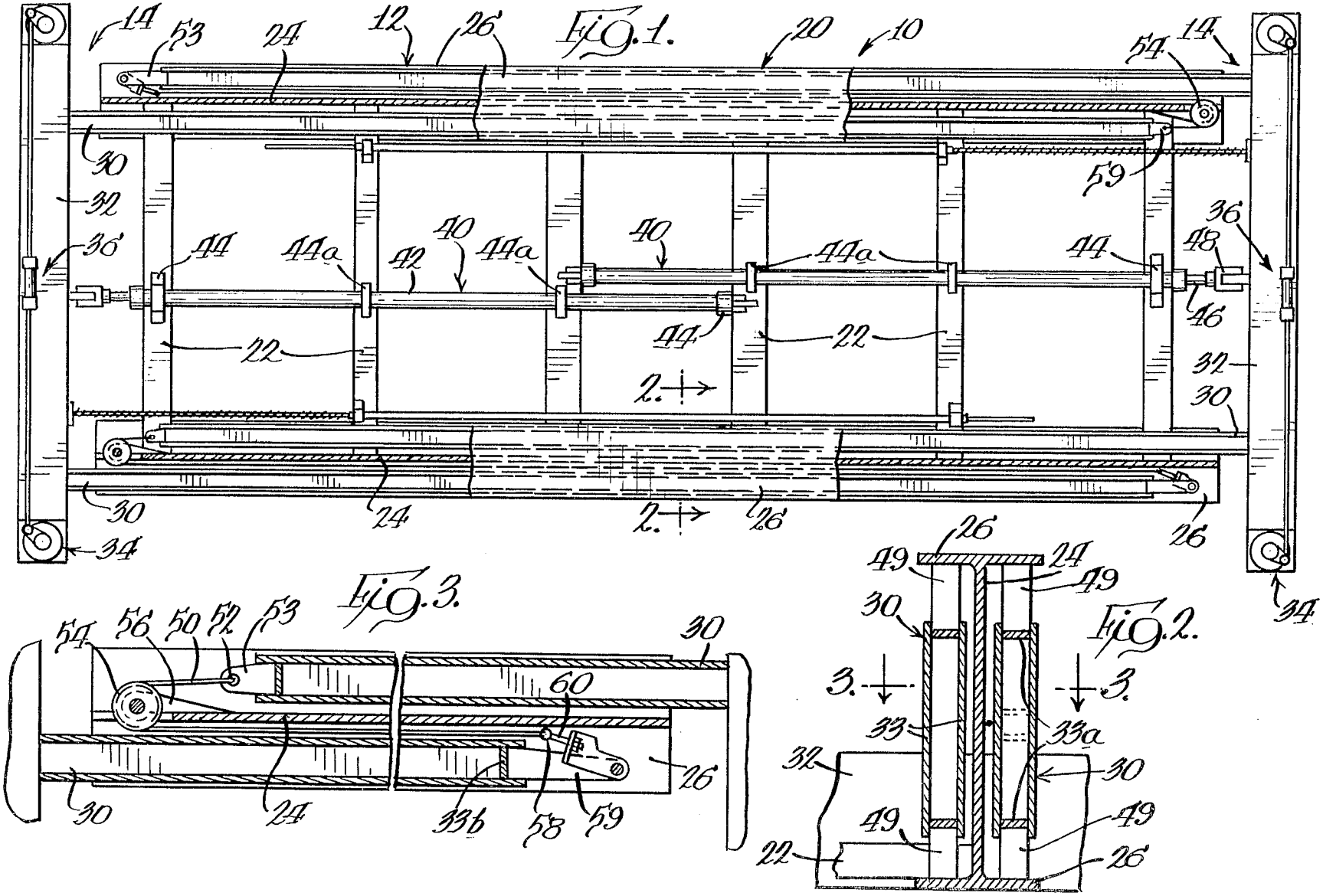
FIG. 1 discloses a plan view of the expandable spreader having the present invention incorporated therein.
FIG. 2 is a cross-sectional view as viewed generally along lines 2—2 of FIG. 1.
FIG. 3 is a fragmentary sectional view, as viewed along line 3—3 of FIG. 2.

While this invention is susceptible of embodiment in many different forms, there is shown in the drawings and will herein be described in detail a preferred embodiment of the invention with the understanding that the present disclosure is to be considered as an exemplification of the principles of the invention and in not intended to limit the invention to the embodiment illustrated.

FIG. 1 of the drawings discloses a spreader assembly generally designated by reference numeral 10 which is preferable of the type that is used in a self-propelled vehicle of the type disclosed in U.S. Ser. No. 844,655, filed Oct. 25, 1977 and assigned to the assignee of the present invention.

Spreader 10 includes a base section 12 and first and second extensible and retractable sections or members 14 extending from opposite ends of section 12. Base section 12 consists of first and second transversely spaced parallel beams 20 which are interconnected by a plurality of cross members 22 to define a substantially rectangular frame. In the preferred embodiment, beam 20 is in the form of an I-beam having a central vertical web portion 24 and a pair of upper and lower horizontal legs 26.

Each extensible section 14 is identical in cross section and only one will be described in detail. Extensible section or member 14 includes first and second transversely spaced parallel legs 30 which are interconnected at their outer ends by a transverse member 32 which may be secured thereto by welding. Legs 30 extend parallel to each other and are spaced from each other by a dimension which is equal to the spacing between the webs 24 of the respective beams 20. Legs 30 may be hollow rectangular beams or any other configuration having sufficient strength to support the weight of the container that is to be lifted. In the illustrated embodiment, legs 30 are formed by a pair of spaced vertical plates 33 interconnected by upper and lower plates 33*a* and end plates 33*b*.

Transverse beams 32 may also be hollow rectangular members each having a latching mechanism 34 at each end thereof. The latching mechanisms are preferably of the type disclosed in copending application Ser. No. 947,550, filed Oct. 2, 1978. Latching mechanisms 34 are moved between the latched and unlatched position through fluid ram means 36 which are described in more detail in the above-mentioned copending application, which is incorporated herein by reference.

Extensible members 14 are moved relative to base section 12 through independent drive means or fluid rams 40. In the illustrated embodiment, each drive means is in the form of a cylinder and piston rod assembly with cylinder 42 supported on cross members 22 and secured thereto by suitable brackets 44. In view of the required length of fluid rams 40, it is preferable to have cylinders 42 also supported intermediate opposite ends by brackets 44*a*. Piston rod 46 of fluid ram 40 is connected to transverse beam 32 through a suitable bracket 48.

Extensible members 14 are guided on base section 12 through novel support means to minimize frictional forces that may develop during extension and retraction. This is accomplished through spaced guide blocks that suspend legs 30 between horizontal legs 26 of I-beam 20.

As illustrated in FIG. 2, plates 33*a* are spaced from the upper and lower edges of vertical plates 33 to define recesses that extend the entire length of legs or beams 30. Each horizontal leg 26 of I-beam 20 has a plurality of longitudinally spaced guide blocks 49 secured to the inner surface thereof and the guide blocks 49 have free end portions received into the recesses on beams 30. The respective guide blocks 49 have a transverse dimension substantially equal to the transverse spacing between plates 33 and the free end portions of blocks preferably have Nylatron surfaces defined thereon to reduce friction.

With beams 30 supported in the manner described, the beams must move along a parallel path and are always spaced from vertical webs 24 of I-beams 20 to reduce the friction to a minimum.

Hydraulic fluid is supplied to opposite ends of fluid rams 40 through a suitable hydraulic circuit and electric control circuit therefor that is disclosed and claimed in copending application Ser. No. 947,548, filed, Oct. 2, 1978, which is incorporated herein by reference. The hydraulic control circuit simultaneously supplies hydraulic fluid from a source to the same end of both cylinders so that the two sections 14 are extended simultaneously at approximately the same rate. However, because frictional forces may vary between the respective members and base section 12, it is virtually impossible to accurately control equal incremental extension of both members 14 in opposite directions.

According to the present invention, spreader 10 incorporates synchronizing means between the base section and each of the extensible members to produce equal increments of movement of both of the extensible members in response to actuation of fluid rams 40. The synchronizing means consists of cable means interposed between base section 12 and each extensible section 14. In the illustrated embodiment, the cable means consists of first and second cables 50 of equal length having opposite ends respectively secured to the respective extensible members 14 and an intermediate portion guided on base section 12. More specifically, each cable 50 (FIG. 3) has one end 52 connected to a bracket 53 supported on the inner free end of beam 30 of a first extensible section and extends generally parallel between the beam 30 and web portion 24 of beam 20 to the opposite end of I-beam 20. A pulley 54 is supported by a bracket 56 on the end of I-beam 20 and an intermediate portion of cable 50 is entrained over pulley 54. The opposite end 58 of each cable 50 is connected by a bracket 59 to the inner end of beam 30 of the second extensible members. Preferably, at least one end of each cable is connected to the associated bracket by an eyebolt so that the effective length can readily be varied.

With the arrangement described above, when hydraulic pressurized fluid is supplied to both fluid rams 40 simultaneously to extend the telescoping members 14 with respect to base section 12, if left-hand extensible member 14 tends to move at a greater rate than the right-hand member 14, upper cable 50, as viewed in FIG. 1, will pull the second or right-hand member or section 14 to cause both members to move equal increments in opposite directions with respect to base section 12. On the other hand, if the right-hand extensible member 14 has a tendency to move at a faster rate than the left-hand member, the lower cable 50 will become taut and will cause the left-hand member 14 to be pulled by the right-hand member. If fluid rams 40 are being retracted, the same condition will occur to insure that both members are simultaneously retracted equal increments during retraction of the fluid ram.

The synchronizing mechanism of the present invention is extremely inexpensive and can readily be incorporated into a telescoping extensible spreader with only minimum modification thereof. With the identical cross-sectional configuration for the two sections 14, the legs of the respective extensible members 14 are located in transverse overlapping relation on the base section. The respective legs 30 of both members 14 are located between the horizontal legs 26 of I-beam 20 and the respective pairs of legs of one member 14 are located on one side of vertical web 24 of I-beam 20 while the two legs of the second extensible member 14 are located on the opposite sides of the vertical webs 24. Also, having the two extensible members 14 of identical configuration reduces the inventory required and also results in a symmetrical distribution of the weight on opposite sides of the longitudinal center line of the base section.

What is claimed is:

1. An extensible spreader comprising an elongated base section and first and second extensible members extending from opposite ends of said base section, independent drive means for moving each of said extensible members on said base section, and synchronizing means between said base section and each of said extensible members for controlling movement of each of said extensible members with respect to said base section to produce equal increments of movement of both of said extensible members in response to operation of said drive means.

2. An extensible spreader as defined in claim 1, in which said synchronizing means includes first and second cables respectively interposed between said base section, one of said cables being operative during extension of said extensible members and the other of said cables being operative during retraction of said extensible members.

3. An extensible spreader as defined in claim 2, in which each of said cables has one end secured to one of said extensible members and another end secured to the other extensible members with an intermediate portion guided on said base section.

4. An extensible spreader as defined in claim 3, in which said base section has first and second pulleys respectively supported on opposite ends thereof with the intermediate portions of the first and second cables respectively entrained over said first and second pulleys.

5. An extensible spreader as defined in claim 1, in which said extensible members are substantially identical in configuration and are positioned in transverse overlapping relation on said base section.

6. An extensible spreader as defined in claim 5, in which said base section has first and second transversely spaced parallel I-beams having vertical webs and horizontal legs and in which said extensible members each have a pair of spaced parallel legs located between said horizontal legs of said I-beams with one pair of spaced parallel legs positioned one side of said vertical webs and the other pair of spaced parallel legs positioned on the other side of said vertical webs.

7. An extensible spreader comprising first and second transversely spaced parallel I-beams interconnected by cross members to define a base section, first and second identical extensible sections supported on said base section, each extensible section including as elongated end member having a latching mechanism at each end and a pair of parallel legs, said legs of respective extensible sections being supported in transverse spaced relation on opposite sides of vertical webs of said I-beams, drive means for extending and retracting said extensible sections on said base section, and flexible synchronizing means interposed between said I-beams and said legs to produce equal movement of said extensible sections on said base section.

8. An extensible spreader as defined in claim 7, in which said drive means includes first and second fluid rams respectively interposed between said base section and said extensible sections and said synchronizing means includes cable means between said I-beams and said legs.

9. An extensible spreader as defined in claim 8, in which said cable means includes first and second cables cooperating with the respective I-beams, each cable having opposite ends respectively connected to free ends of one of said legs of each extensible section and an intermediate portion guided on an associated I-beam.

* * * * *